United States Patent [19]

Seller

[11] 4,377,311

[45] Mar. 22, 1983

[54] MULTI-PURPOSE MINING MACHINE

[75] Inventor: Barry Seller, Sydney, Australia

[73] Assignee: Fox Manufacturing Company Pty. Limited, Australia

[21] Appl. No.: 231,457

[22] Filed: Feb. 4, 1981

[51] Int. Cl.[3] ..... E21C 27/24

[52] U.S. Cl. ..... 299/75; 299/64

[58] Field of Search ..... 299/55, 56, 64, 71–76

[56] References Cited

U.S. PATENT DOCUMENTS 2,788,203 4/1957 McCallum ..... 299/72

FOREIGN PATENT DOCUMENTS 1248589 8/1967 Fed. Rep. of Germany ..... 299/56

1086701 10/1967 United Kingdom ..... 299/56

*Primary Examiner*—Ernest R. Purser

*Attorney, Agent, or Firm*—Nelson E. Kimmelman

[57] ABSTRACT

A multi-purpose mining machine comprising a self-propelling power unit with a boom pivotally connected to the power unit for raising and lowering movements, the boom having two parts one connected to the power unit and the other being connected to said one part so as to be slewable relative thereto about an axis at 90° to the axis of the connection of the boom to the power unit, the boom other part being in part downwardly inclined with a power shaft rotatably housed in the boom other part with drive means for the power shaft, and extensible means to raise and lower the boom and further extensible means to slew the boom one part relative to the other part thereof.

9 Claims, 4 Drawing Figures

MULTI-PURPOSE MINING MACHINE

This invention relates to mining machinery and provides a multipurpose machine which when fitted with one head can be used to drive an underground road and when fitted with another form of head can be used to cut underground deposits, such as coal.

Considerable time and effort is required to locate a mining machine in an underground mine and to relocate machines of specialised form once their work is completed. For example, to replace a road heading machine by a continuous miner, or vice versa. Because the capital cost of and the production rate of a mining machine is so great, non-productive time must be kept to a minimum. A versatile machine able to be readily converted for one use or another, say for road heading or coal cutting, provides a solution to the present problem of having to provide a separate machine for each operation.

This invention provides a machine having a continuous miner type power unit with a tool carrying boom mounted thereon adapted to have a cutting head coupled thereto.

Broadly the invention provides a machine comprising a self-propelling power unit, a boom comprising a first part and a second part, a first pivotal connection between the power unit and the boom first part with an axis of pivot generally horizontal, a second pivotal connection between the boom first and second parts, with an axis of pivot substantially at right angles to the axis of the first pivotal connection, the boom second part including an elongated section lying at a depressed angle to the horizontal, extensible raising and lowering means connecting the power unit to the boom first part, extensible slewing means connecting the boom first and second parts, shaft driving means on the boom second part, a power shaft rotatably housed in the boom second part and coupled to the shaft driving means and coupling means at the output end of the power shaft and the adjacent end of the boom second part to allow driving connection to a cutting tool.

A presently preferred embodiment of the invention will now be described with reference to the accompanying drawings in which.

Figure 1:
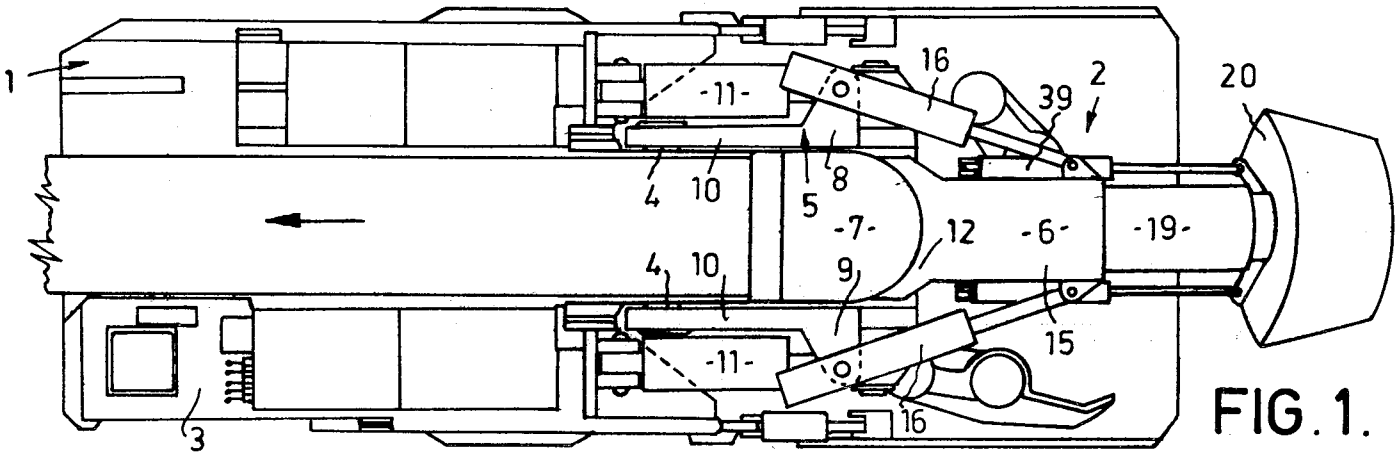
FIG. 1 is a general top view of the machine.
Figure 2:
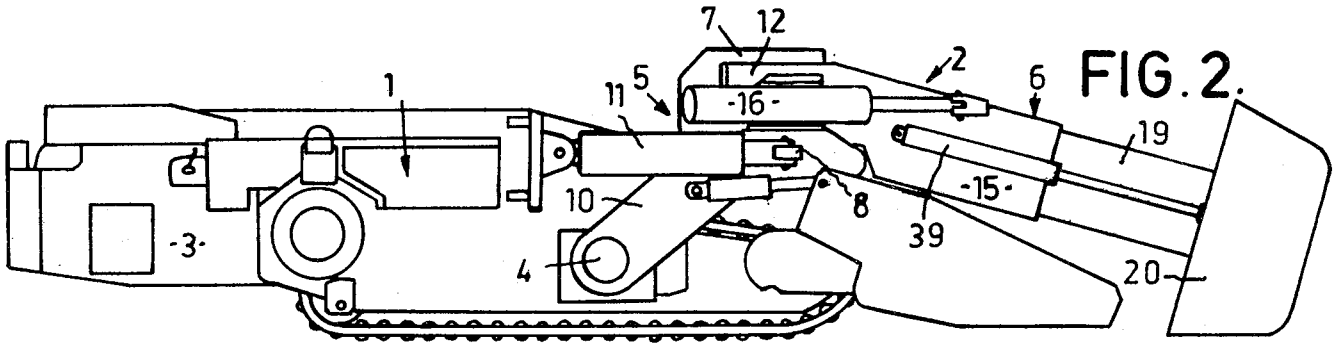
FIG. 2 is a general side view of the machine.
Figure 3:
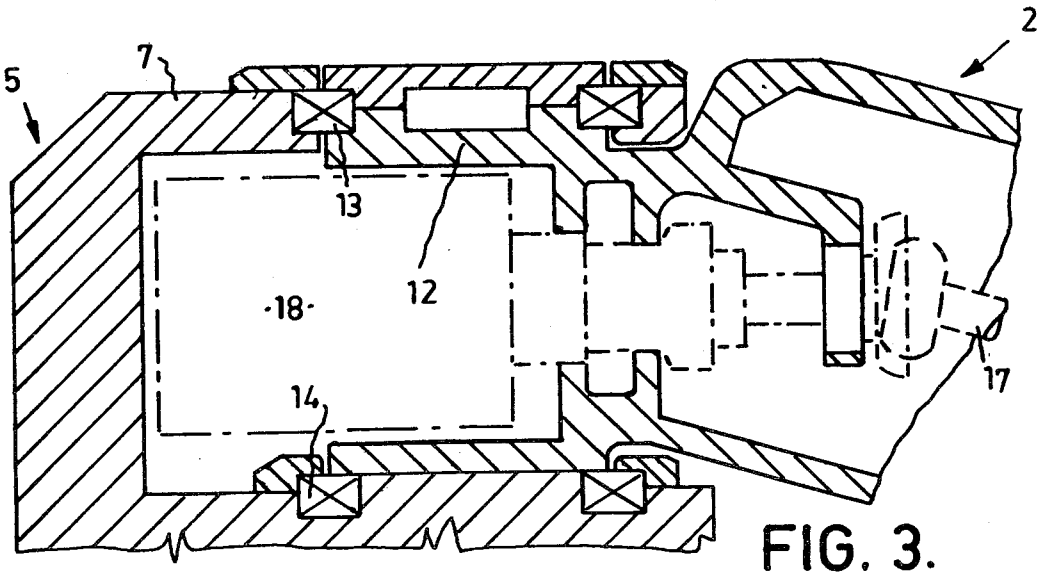
FIG. 3 is a fragmentary view of the pivot connection between boom parts.

The basic components of the machine are the prime mover 1 and the boom 2. The prime mover 1 is self propelling and of the type found in continuous mining machines incorporating a driver station 3 with controls to operate the machine. On the prime mover there is a pivot bearing means 4 having a generally horizontal axis lying transverse to the direction of machine movement.

The boom 2 is comprised of a first part 5 and a second part 6. The part 5 incorporates a head 7 with wings 8 and 9 and two arms 10 located one to either side of the prime mover 1 to connect the head 7 to the pivot bearing means 4. The boom first part 5 is moved up and down about the axis of the bearing means 4 by two piston and cylinder assemblies 11 respectively connecting the wings 8 and 9 of the head 7 to the prime mover 1.

The head 7 is in the form of a yoke to provide an opening to receive an end zone 12 of the boom second part 6. The boom end 12 is rotatable about an axis at 90° to the axis of the bearing means 4 and is supported by upper and lower bearings 13 and 14. The boom second part 6 comprises the end zone 12 and a second elongated zone 15 which lies at a depressed angle to the horizontal. The boom second zone 15 is illustrated as telescopic, whilst this is desirable it is not an essential of the invention. The boom is slewed in the bearings 13 and 14 by slewing means comprised of two piston and cylinder assemblies 16 connecting the boom first and second parts 5 and 6.

Figure 4:
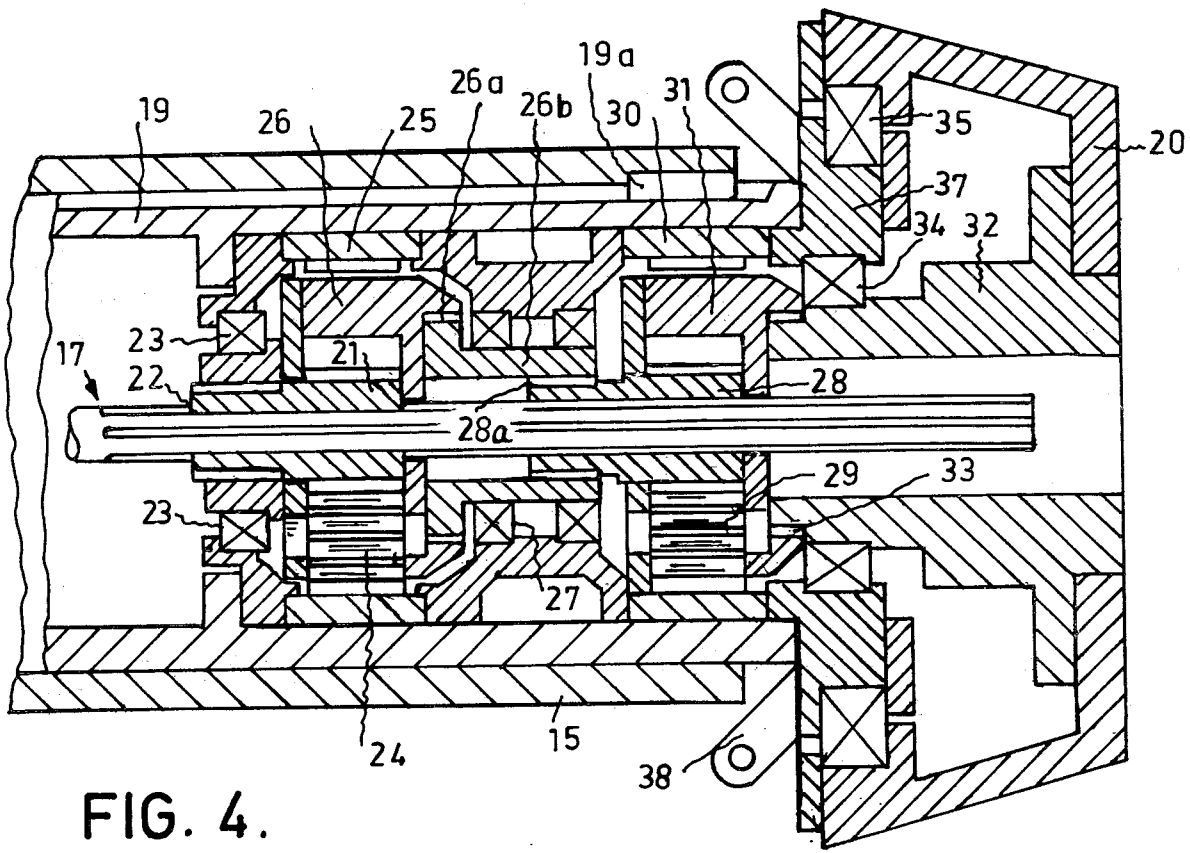
FIG. 4 is a diagrammatic view of a cutter assembly showing how it is coupled to the machine drive shaft.

Housed within the boom there is a rotatable shaft 17 coupled at one end through a constant velocity joint to a motor/gearbox assembly indicated 18 shown in dotted outline and housed in the boom zone 12. The shaft 17 is coupled at the other end to a cutting head. This is shown diagrammatically in FIG. 4.

The cutter assembly illustrated is for road heading. It comprises a sleeve 19 slidably mounted in the bore of the boom zone 15. There is a sliding key-keyway connection between the sleeve 19 and the boom 15 to prevent relative rotation but permit telescopic movement; this is indicated 19*a*. Housed in the sleeve 19 there is a number of gears to provide a speed reduction between the shaft 17 and the cutter 20. The gears comprise a first sun wheel 21 splined internally to engage external splines on the shaft 17, as at 22. The sun wheel 21 is held central in the sleeve 19 by bearing 23. The sun wheel 21 meshes with three planet gear wheels 24, only one is shown in detail, and they mesh with an internal ring gear 25 fixed in the sleeve 19. The planet wheels 24 are mounted on a carrier 26, splined as at 26*a* to a bearing support 26*b* supported rotatably by bearing 27, and having an internal spline to engage with an external spline on a second sun wheel 28, as indicated 28*a*. The second sun wheel 28 does not have internal splines to be engaged by the external splines of the shaft 17. Three further planet gear wheels 29 mesh with the second sun wheel 28 and an internal ring gear 30 fixed in the sleeve 19. The planet wheel 29 is mounted on a carrier 31 with internal splines to engage the external splines of the cutter hub 32, as at 33. Inner and outer bearings 34 and 35 support the cutter hub 32 and the cutter 20 from a support ring 37 fixed to the sleeve 19. The cutter 20 is fixed to the hub 32 by screws or bolts as required. Two diametrically located lugs 38 on the hub 32 provide first end connections for two piston and cylinder assemblies 39 which are coupled at their other ends to the boom. By extending and contracting the assemblies 39 the boom may be extended or shortened.

In the embodiment illustrated a road driving cutter is illustrated. It is of truncated cone shape and the angle of the cone is such that when the boom is approaching its lowest position the lowest part of the cutter is a line substantially parallel to the horizontal. To form the floor of a road it is only necessary to slew the rotating cutter from side to side by means of the piston and cylinder assemblies 16. The walls and roof of the road can be shaped by combinations of movements of the piston and cylinder assemblies 11 and 16. One method is to vertically elevate the boom after forming the floor and to move the cutter horizontally and to continue such operations whilst progressively limiting the horizontal travel to provide a wall and roof configuration that approximates a semicircle. Alternatively, a programmed operation of boom raising and boom slewing can be followed to achieve the profile desired.

The cutting head, after road heading, would be changed to one suited for coal cutting. Two types of coal cutters are commonly used, both can be readily attached to the machine of this invention thereby allowing substantially un-interrupted operation of the machine. Replacement involves releasing the connections of the piston and cylinder assemblies 39 from the lugs 38, the withdrawal of the cutter-bearing-gear assembly by sliding the sleeve 19 from boom 15 and replacement by a different cutter-bearing-gear assembly with engagement of shaft end 17 in the new sun wheel 21 and engagement of the key-keyway connection 19*a*, followed by the re-connection of the piston and cylinder assemblies 39. The gearing would be as required to provide the cutting speed for the cutter selected. It will be seen that conversion from one mode of operation to another is very simply achieved.

In one form of cutter there is a pair of cutting wheels spaced apart and connected to a common driving shaft through a right angle drive, the machine drive shaft 17 is coupled to right angled drive. Thus the drive shaft 17 can be made to drive a cutting head that rotates co-axially with the shaft 17 or can provide a drive for a pair of cutter wheels rotating about an axis at right angles to the axis of the shaft 17.

The machine as described has a telescopic boom, as stated previously this is not essential and a machine with a fixed length boom is also to be considered as being covered by this application. In the case of a machine with a fixed boom length the cutter assembly would be substantially as herein described and in one form would comprise a sleeve 19 with its associated gearing and bearings which would be mounted in the boom part 15 by releasable fastenings. It is also to be noted that the angled relationship between the motor/gearbox 18 and the shaft 17 making it necessary for the illustrated constant velocity joint is only the presently preferred arrangement and it is envisaged that the power output shaft of the motor/gearbox 18 could be aligned with the shaft 17. The arrangement illustrated allows the machine to operate in conditions of lower overhead clearance than would be the case with the shaft 17 axially aligned with the motor/gearbox 18.

I claim:

1. A mining machine adapted to be propelled by a power unit, comprising a boom including a first part and a second part, a pivotal coupling between the power unit and said first part, the axis of said pivotal connection being generally horizontal, a pivotal coupling between said first and second parts, the axis of said latter coupling being substantially at right angles to the axis of the former pivotal coupling, said second part comprising an elongated and generally hollow first section and an elongated second section slideably housed in said first section, said second section including gear means, cutter means, and means for coupling said cutter means to said gear means, driving means disposed in said first section and adapted to be demountably coupled to said gear means, and means for adjusting the length of said boom by sliding said second section within said first section, said adjusting means being releasably coupled to said second section whereby said second section with said gear means, said cutter means, and said means for coupling said cutter means to said gear means may be removed from said machine and another second section may be substituted therefor.

2. The mining machine according to claim 1 wherein said first section lies at a depressed angle relative to the horizontal.

3. The mining machine according to claim 1 wherein means are provided to prevent rotation of said second section relative to said first section.

4. The mining machine according to claim 1 with the addition of extensible raising and lowering means coupling said power unit to said boom first part, extensible slewing means coupling said boom first and second parts, and wherein said means for adjusting the length of said boom includes pivotal connections at one end to said first section and pivotal and releasable connection means for coupling said cutter means to said gear means.

5. A mining machine as claimed in claim 4 wherein the boom raising and lowering and slewing means are piston and cylinder assemblies.

6. A mining machine as claimed in claim 1 wherein the means for adjusting the length of said boom include piston and cylinder assemblies.

7. A mining machine as claimed in claim 1 wherein the boom second section is a part of a cutting tool assembly.

8. A mining machine as claimed in claim 1 including a speed reduction means in the boom second section, and said driving means includes an input shaft coupled to said gear means with a telescopic driving connection between said input shaft and said driving means.

9. A mining machine adapted to be propelled by a power unit, comprising:

a boom including a first part and a second part, a pivotal connection between said power unit and said first part with an axis of pivot that is generally horizontal, a pivotal connection between said first and second parts with an axis of pivot substantially at right angles to the axis of said first-named pivotal connection, said boom second part comprising an elongated and generally hollow first section lying at a depressed angle to the horizontal and an elongated second section slideably and removably housed in said first section, rotation-preventing means to prevent rotation of said second section relative to said first section, a gear box mounted in said second section at the work end thereof projecting from said first section, a cutter support at the work end of said second section on which a cutter means can be rotatably mounted so as to be driven when coupled to said gear box, shaft driving means associated with said first section, a power shaft extending through said first section into said second section and being drivingly and slideably engaged at one end with said gear box and at the other end with said driving means, extensible raising and lowering means coupling said power unit to said first part, extensible slewing means coupling said first and second parts of said boom, and boom length adjusting means for telescopically moving said second section relative to said first section, said adjusting means being pivotally coupled at one end to said first section and pivotally and releasably coupled at the other end to said cutter support.

* * * * *